US006896535B2

(12) United States Patent
Yamada et al.

(10) Patent No.: US 6,896,535 B2
(45) Date of Patent: May 24, 2005

(54) MULTICORE CONNECTOR FOR CONNECTING A PLURALITY OF CONTACT PADS OF A CIRCUIT BOARD TO A PLURALITY OF CONTACTS IN A ONE-TO-ONE CORRESPONDENCE

(75) Inventors: Masahiro Yamada, Sagamihara (JP); Kazuo Ikenaka, Machida (JP)

(73) Assignee: ITT Cannon, Ltd., Zama (JP)

( * ) Notice: Subject to any disclaimer, the term of this patent is extended or adjusted under 35 U.S.C. 154(b) by 0 days.

(21) Appl. No.: 10/606,519

(22) Filed: Jun. 26, 2003

(65) Prior Publication Data

US 2004/0002249 A1 Jan. 1, 2004

(30) Foreign Application Priority Data

Jun. 27, 2002 (JP) ..... 2002-188407

(51) Int. Cl.[7] ..... H01R 13/639

(52) U.S. Cl. ..... 439/289; 439/66; 439/607; 439/953

(58) Field of Search ..... 439/372, 76.1, 439/342, 953, 289, 108, 607, 66

(56) References Cited

U.S. PATENT DOCUMENTS 4,026,623 A * 5/1977 Goodman et al. ..... 439/261
5,310,352 A * 5/1994 Mroczkowski et al. .... 439/76.1
5,588,866 A 12/1996 Rothenberger ..... 439/372
6,056,581 A * 5/2000 Rothenberger ..... 439/372
6,257,918 B1 * 7/2001 Yamamoto ..... 439/364
6,522,532 B2 * 2/2003 Liao et al. ..... 361/686
6,530,801 B2 * 3/2003 Bates et al. ..... 439/364
6,652,292 B2 * 11/2003 Pratt et al. ..... 439/76.1

* cited by examiner

*Primary Examiner*—Neil Abrams
(74) *Attorney, Agent, or Firm*—Ohlandt, Greeley, Ruggiero & Perle, L.L.P.

(57) ABSTRACT

A connector has a board with a plurality of contact pads electrically connected to a plurality of signal lines on one side. The connector also has a modularized structural unit on the other side. The structural unit includes a plurality of spring contacts as the mate to which the contact pads are electrically connected. The connector further has a shaft provided near the central part of the board and perpendicular to the board and a roller provided on the structural unit. To combine the contact pads and the contacts, the shaft is rotated to cause the rollers to engage with a projecting part provided at the tip of the shaft. The roller is provided higher in position than the circuit board on which the connector is to be mounted.

17 Claims, 11 Drawing Sheets

MULTICORE CONNECTOR FOR CONNECTING A PLURALITY OF CONTACT PADS OF A CIRCUIT BOARD TO A PLURALITY OF CONTACTS IN A ONE-TO-ONE CORRESPONDENCE

CROSS-REFERENCE TO RELATED APPLICATIONS

This application is based upon and claims the benefit of priority from the prior Japanese Patent Application No. 2002-188407, filed Jun. 27, 2002, the entire contents of which are incorporated herein by reference.

BACKGROUND OF THE INVENTION

1. Field of the Invention

This invention relates to a connector usable in, for example, medical instruments, such as ultrasonic diagnostic equipment, semiconductor testing equipment, computers, and industrial equipment with a multicore electric input/output section, such as communications equipment.

2. Description of the Related Art

More particularly, this invention relates to a multicore connector with a plug and a receptacle used for an electrical connection between electronic apparatuses utilizing a multicore cable or the like.

Sophisticated electronic apparatuses, including medical instruments, semiconductor testing equipment, computers, and communications equipment, have been getting smaller in size and more sophisticated. In addition, the signals they have to transmit and receive have become more diversified and complex. Thus, the input/output and transmission/reception cables of a plurality of electronic apparatuses connected to one another tend to have more cores, which thus requires multicore connectors smaller in size, higher in density, and of higher reliability.

Multicore connectors involve connection of many contact parts. When a plug and a receptacle are connected to each other, and when the plug is pulled out of the receptacle, it is desirable that the insertion force and the pulling force be very small. Furthermore, there have been demands for long-service-life connectors with less wear of the contact parts.

FIG. 11 shows an example of a conventional multicore connector 100. The multicore connector 100 is composed of a plug 101, connected to one (not shown) electronic apparatus, and a receptacle 102, connected to another (not shown) apparatus. When they are connected to each other, after the plug 101 is inserted into the receptacle 102 (with zero insertion force) and joined with each other, a handle 103 is turned, thereby rotating a cam shaft 104 provided on the plug central part.

By this process, the action of a cam 105 provided in the lower part of the cam shaft 104 slides an actuator 106 in the lateral direction, thereby moving a contact 108 formed at the tip of a contact pin 107 to a contact 109 of the receptacle 102 in such a manner that the contact 108 comes into contact with the contact 109. Each contact pin is displaced elastically, causing the contact 108 of the plug 101 to press against the corresponding contact 109 of the receptacle 102, which connects the plug and receptacle to each other electrically. The rotation of the cam shaft 104 sets a lock between the plug 101 and the receptacle 102, which secures the plug 101 to the receptacle 102 reliably.

For instance, in an ultrasonic apparatus, when this type of connector is used to connect the signal cable of the ultrasonic sensor to the apparatus body, the following approach is used: the receptacle 102 is fixed to the circuit board (not shown) in the ultrasonic apparatus and each contact terminal 110 is soldered to the corresponding wire on the circuit board, and the plug 101 is engaged with the receptacle 102, thereby making an electrical connection. To wire the plug with a multicore cable, the cores of the multicore cable (not shown) are contact-bonded or soldered to contact terminals 111. Alternatively, the contact terminals are mounted on a specific circuit board. Then, a cable is drawn out of the wiring of the circuit board. However, in the conventional multicore connector of FIG. 11, the contacts 108 and 109 are long, which permits crosstalk or a similar problem to occur between the contacts, depending on usage.

FIG. 12 shows a conventional example of a multicore connector 200 developed to solve the crosstalk problem or the like. The multicore connector 200 is also composed of a plug 201 and a receptacle 202 as the connector of FIG. 11. FIG. 12 shows a state where the plug 201 and the receptacle 202 are connected to each other electrically in the conventional example.

The plug 201 has a plug housing 203. In the lower part of the housing 203, there is provided a plug board 204 composed of a multilayer wiring insulating board. On the top surface of the plug board 204, a plurality of electrode pads 205 are formed which are to be connected to the individual cores (not shown) of the multicore cable extending from one electronic apparatus to be connected. A plurality of contact pads 206 corresponding to the electrode pads 205 are formed on the bottom surface of the plug substrate 204, which connects the contact pads 206 corresponding to the electrode pads 205 to the electrode pads 205 electrically inside the plug board 204. The plug 201 further has a cam shaft 207 provided rotatably in the central part of the plug. At the top of the cam shaft, there is provided a handle 208 for pressing the plug 201 against the inside of the receptacle 202 and at the same time, rotating the cam shaft 207.

Moreover, the housing 203 is provided with a spring support section 209 for actuating the cam shaft 207 upward, and a spring 220. The cam shaft 207 has a ringed brim projecting from its side which presses against the spring 220.

The receptacle 202 has a receptacle housing 209. In the lower part of the housing 209, a receptacle board 210 is provided. On the top surface of the receptacle board 210, a plurality of contact pads 211 (or contact strips) to be pressed against the contact pads 206 of the plug are formed. On the bottom surface of the receptacle board 210, a plurality of electrode sections 213 are formed which are internally connected to the contact pads 211 and electrically connected to the printed wiring board 212 of the other electronic apparatus.

The receptacle 202 further has a stiffener 214 serving as a support member in its lower part. The printed wiring board 212 of the other electronic apparatus is inserted between the stiffener 214 and the bottom surface 215 of the receptacle housing 209 and then screwed there (not shown), thereby fixing the receptacle 202 to the circuit board 212. The receptacle 202 is provided with a set of folding doors 222 on both sides. When the plug 201 is not inserted, the doors 222 are turned horizontally to close the receptacle 202.

To connect the plug 201 and the receptacle 202, the plug 201 is inserted into the receptacle 202 in such a manner that the doors 222 are forced open left and right and the cam shaft 207 is further pressed downward, opposing the actuation of the spring 220. Then, the cam shaft 207 is rotated with the handle 208, thereby pulling a projecting part 216 sticking out of the cam shaft 207 under the locking surface 218 of the central concave part 217 of the bottom surface of the stiffener 214. As a result, the elastic force of the spring 220 makes an electrical connection between the individual contact pads 206, 211 of the plug and receptacle. To remove the plug 201, the cam shaft 207 is pressed downward, opposing the actuating force of the spring 220, and then is rotated in the opposite direction, thereby unlocking the projecting part 216.

In the conventional multicore connector 100 of FIG. 11, turning the handle causes the contacts to move in the lateral direction by means of the cam mechanism near the center, which assures the operation capability with a ZIF (zero insertion force) structure. Since the contact pins 107, 109 are deformed elastically to make contact with one another, as the number of cores increases, the rotational torque of the cam shaft 104 becomes larger at the time of engagement, which is a problem. Furthermore, since spring actions are needed, this lengthens the signal line, making interference, such as crosstalk, liable to take place in the transmission characteristic of the electric signals, which tends to have an adverse effect on the transmission of high-speed signals.

Furthermore, in a conventional multicore connector 200 of FIG. 12, since no contact pin is used, the signal lines in the longitudinal direction become shorter, enabling the height of the connectors in the longitudinal direction to be reduced. However, to increase the rigidity of the connector 200 and connect the connector 200 to the circuit board 212 on which the connector 200 is to be mounted, a stiffener 214 to fix the connector 200 to the board 212 has to be provided on the back of the board 212. Furthermore, an opening 223 has to be made in the board. As a result, the connector 200 is made larger on the whole and the parts mounting area is made smaller, which is a problem. In addition, there is another problem: even if the plug housing 203 and receptacle housing 209 are made of a metal, it is difficult to make electrical connection to cause them to be grounded completely.

An object of the present invention is to provide a multicore connector which makes the rotational torque of the cam shaft smaller and shortens the signal lines to improve the EMI characteristic, or the transmission characteristic of electric signals, and prevent interference, such as crosstalk, and which is suitable for the transmission of high-speed signals. Another object of the present invention is to provide a multicore connector which reduces the number of parts to be mounted on an electronic apparatus, makes the parts mounting area smaller by downsizing the whole connector, and enables the plug housing and receptacle housing to be grounded completely.

BRIEF SUMMARY OF THE INVENTION

As explained in embodiments of the present invention shown in FIGS. 1 to 10, such contact pads 17 as contact the electrical contact sections 34 of a receptacle 2 directly to make an electrical connection are formed on one side of the plug board 5 of a plug 1. On the mating receptacle 2, a plurality of spring contactors, or receptacle contacts 34, are formed. By doing this, the signal lines on the whole connector can be shortened.

The contacts 34 on the receptacle 2 side can be modularized in units of a specific number of contacts as shown in FIG. 6. Although the present invention is not limited to the modularization of contacts, use of a structure with a plurality of contact modules enables a great many contact sections to be formed. Use of a plurality of contact modules conforming to the same standard according to the number of contacts needed makes it possible to form various types of multicore connectors easily according to the number of cores needed. Consequently, it is possible to give flexibility to the design.

Furthermore, a plurality of spring contacts bringing the shell section of the plug frame 3 and the receptacle housing 11 into contact with each other, or grounding plate springs 25 can be provided on the inner periphery of the receptacle housing 11. This structure makes a reliable electrical connection between the plug frame 3 and the grounded receptacle housing 11, which provides a structure capable of improving the EMI characteristic of the multicore connector related to the present invention.

In addition, a grounding conductive pattern 30 is provided on the periphery of the plug board 5, which provides a structure where the shell section of the plug frame 3 connected to the grounding pattern makes contact with a number of grounding springs provided around the module connector.

A connector according to the present invention has a structure where an engaging section including rollers 15 for engaging the plug frame with the receptacle housing and a shaft 6 is provided inside the connector. For instance, as compared with a conventional multicore connector shown in FIG. 12, the plug pulling-in action can be completed only within the multicore connector. This makes it unnecessary to use the support member 214 provided under the conventional circuit board 212.

According to the present invention, there is provided a connector for connecting a plurality of signal lines to a specific electronic apparatus that uses the signal lines. The connector comprises: a first structural unit which includes a board having a plurality of contact pads to be electrically connected to the plurality of signal lines and a substantially hollow cylindrical shaft to rotate, the shaft passing through the board, extending perpendicular to the board and having a projecting part protruding from one side; and a second structural unit which includes a bottom, a plurality of spring contact sections provided on the bottom and a rotatable roller provided on the bottom, each of the spring contact sections facing, at one end, the corresponding one of the contact pads and being connectable, at the other end, to the specific electronic apparatus. The first structural unit can be inserted, in part, into the second structural unit. The roller comes close to the shaft when the shaft and a part of the first structural unit are inserted into the second structural unit. When the first structural unit is inserted, in part, into the second structural unit and the shaft is rotated through a specific angle, the projecting part comes to a position beneath to push the board against the contact sections. The contact pads therefore contact the contact sections, respectively.

DETAILED DESCRIPTION OF THE INVENTION

Figure 1:
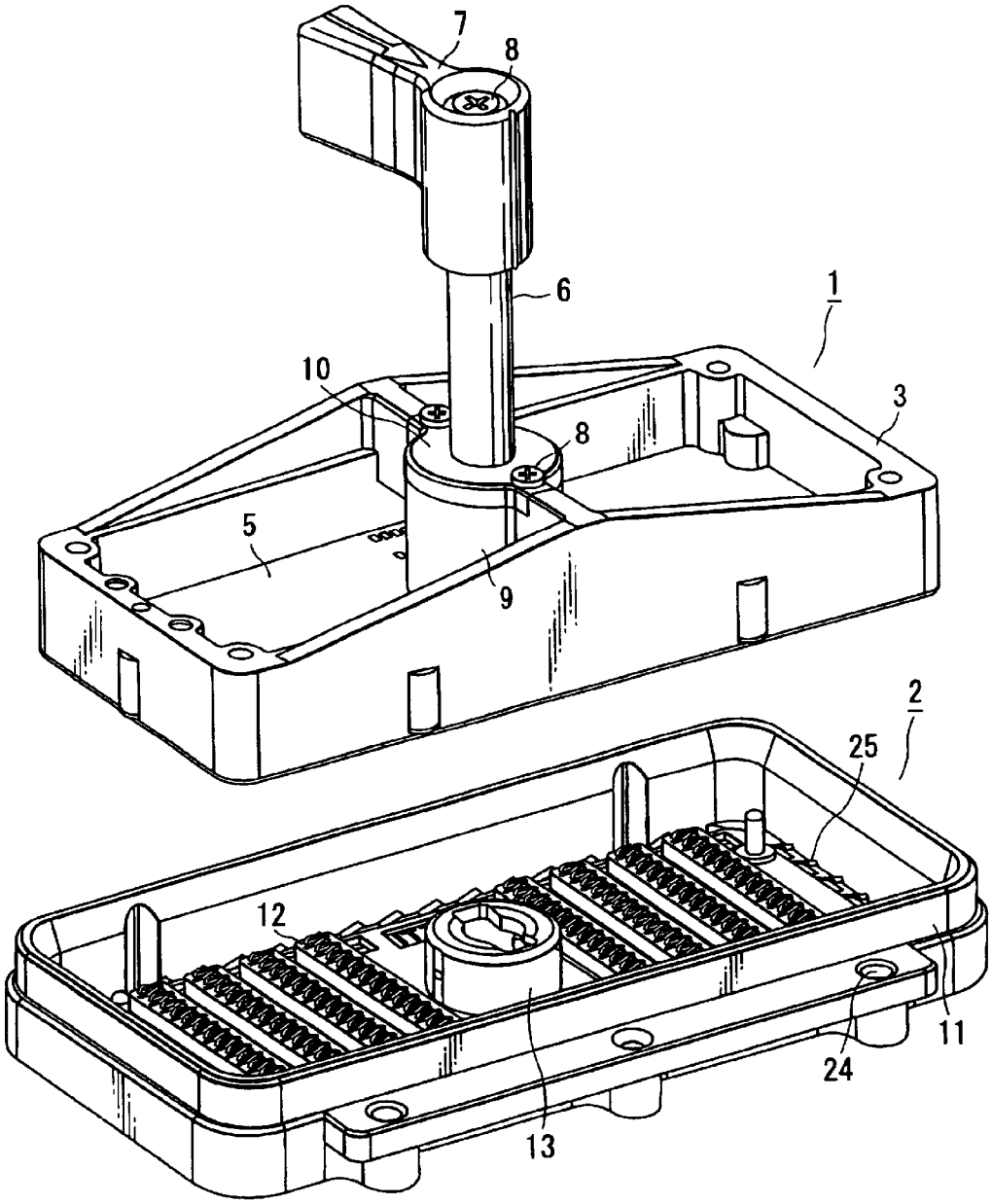
FIG. 1 is a perspective view, from diagonally above, of a plug and a receptacle constituting a multicore connector according to an embodiment of the present invention.

Referring to the accompanying drawings, embodiments of the present invention will be explained. FIGS. 1 to 10 show multicore connectors according to embodiments of the present invention. In the detailed explanation below and the description of the drawings, like elements are indicated by like reference numerals.

FIG. 1 is a perspective view, from diagonally above, of a plug 1 and a receptacle 2 constituting a multicore connector according to the present invention. The terms representing directions, including up, down, longitudinal, and lateral directions, used in this specification are used on the basis of examples shown in the accompanying drawings. Actually, the multicore connectors may be placed diagonally or upside down on the accompanying drawings.

In FIG. 1, a plug 1 includes a plug frame 3 made of, for example, a metal member, so that at least its surface is conductive, a plug board 5 attached to the lower part of the plug frame 3 with, for example, screws 4 (see FIG. 2), and a cam shaft 6 composed of a substantially cylindrical shaft provided rotatably on a cylindrical section 9 formed in almost the central part of the plug board 5 with respect to the plug frame 3.

Figure 2:
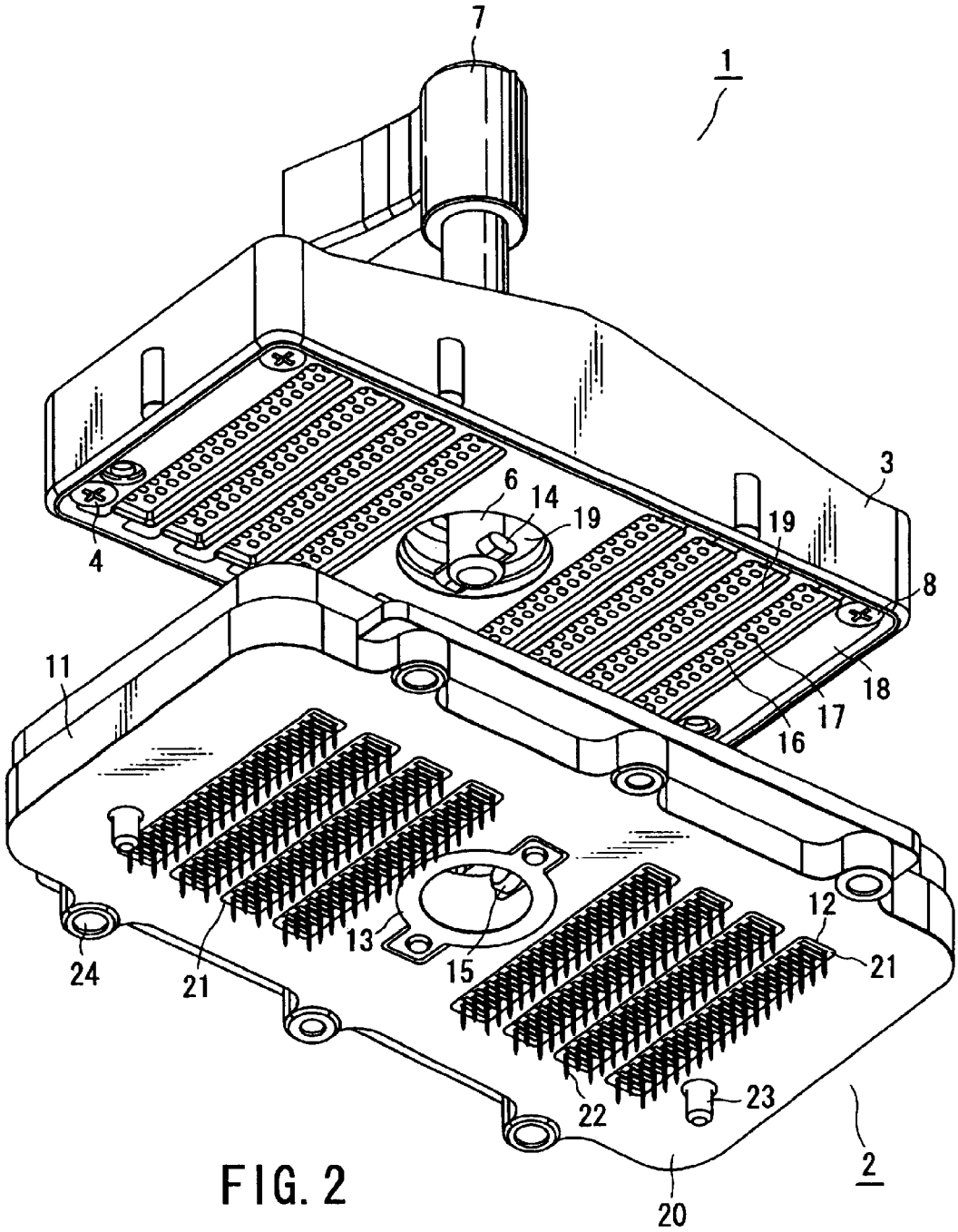
FIG. 2 is a perspective view, from diagonally below, of the plug and receptacle constituting the multicore connector according to the embodiment.

The cam shaft 6 is provided in the vertical direction with respect to the board 5. As shown in FIG. 2, the cam shaft 6 passes through a through hole 28 made in the board 5, with its lower part penetrating the board 5. In the upper part of the cam shaft 6, a handle 7 is fixed to the shaft 6 with a screw 8. The handle 7 makes it easy to insert and remove the plug 1 into and from the receptacle 2 and enables the cam shaft 6 to rotate on its axis to fix the plug 1 to the receptacle 2.

A ring-shaped frame cover 10 is fixed to the upper part of the cylindrical section 9 with screws. Although it is desirable that the cam shaft 6 be formed in the central part of the plug frame 3 as shown in FIG. 1, it is not necessarily formed in the center.

The receptacle 2 includes a receptacle housing 11 made of, for example, a metal member, so that at least its surface is conductive, a plurality of grounding plate springs 25 composed of, for example, elastic metal plates provided along the inner wall of the receptacle housing 11, and a plurality of metal contact strips or contacts 34 provided in lines in the lower part of the receptacle housing 11. The contacts 34 may be composed of a contact module formed by arranging a plurality of contact strips beforehand. As shown in FIG. 1, the contact module may be divided into groups, which may be used as contact modules 12. It is desirable to divide the contact module in this way. The springs 25, which are conductive, enable an electrical connection between the plug frame 3 and the receptacle housing 11. The springs 25 are not limited to a plate-like shape bent convexly in the middle as shown in FIG. 1, and may have a coil-like shape.

In the central part of the receptacle housing 11, there is provided a substantially cylindrical bushing 13 with an opening 50 into which the lower part of the cam shaft 6 is inserted. While in the embodiment, the bushing 13 is formed separately from the receptacle housing 11 and then mounted on the receptacle housing 11, the bushing 13 and the receptacle housing 11 may be formed integral.

FIG. 2 is a perspective view of the plug 1 and receptacle 2, both obliquely seen from below. The plug 1 and the receptacle 2 constitute a multi-core connector according to the invention. A pair of rod-like projecting parts 14 protrude from the lower part of the cam shaft 6. The projecting parts 14 have an almost oval cross section and horizontally extend from the side of the cam shaft 6. The projecting parts 14 are used in association with a pair of rollers 15 that are provided in the bushing 13 of the receptacle 2. Thus, they work as a cam for pressing the lower part of the plug 1 against the upper part of the receptacle 2. The cross section of the projecting parts 14 is not limited to an oval one. It may have any other appropriate shape, as long as the parts 14 can come to positions beneath he rollers 15 to push the rollers 15 upwards when they are rotated in a horizontal plane. For example, each part 14 may have a circular cross section or a rectangular cross section. Moreover, the number of projecting parts is not limited to two.

As shown in FIG. 2, on the bottom surface 16 of the plug substrate 5, a plurality of contact pads 17 are formed. In the lower part of the plug frame 3, to protect the contact pads 17, a protective cover 18 with a plurality of circular or almost rectangular openings 29 is provided in the lower part of the plug board 5 and fixed to the plug frame 3 with screws 4. The lower part of the cam shaft 17 passes through the circular opening. In the rectangular openings, the corresponding contact pads 17 can be exposed.

Figure 6:
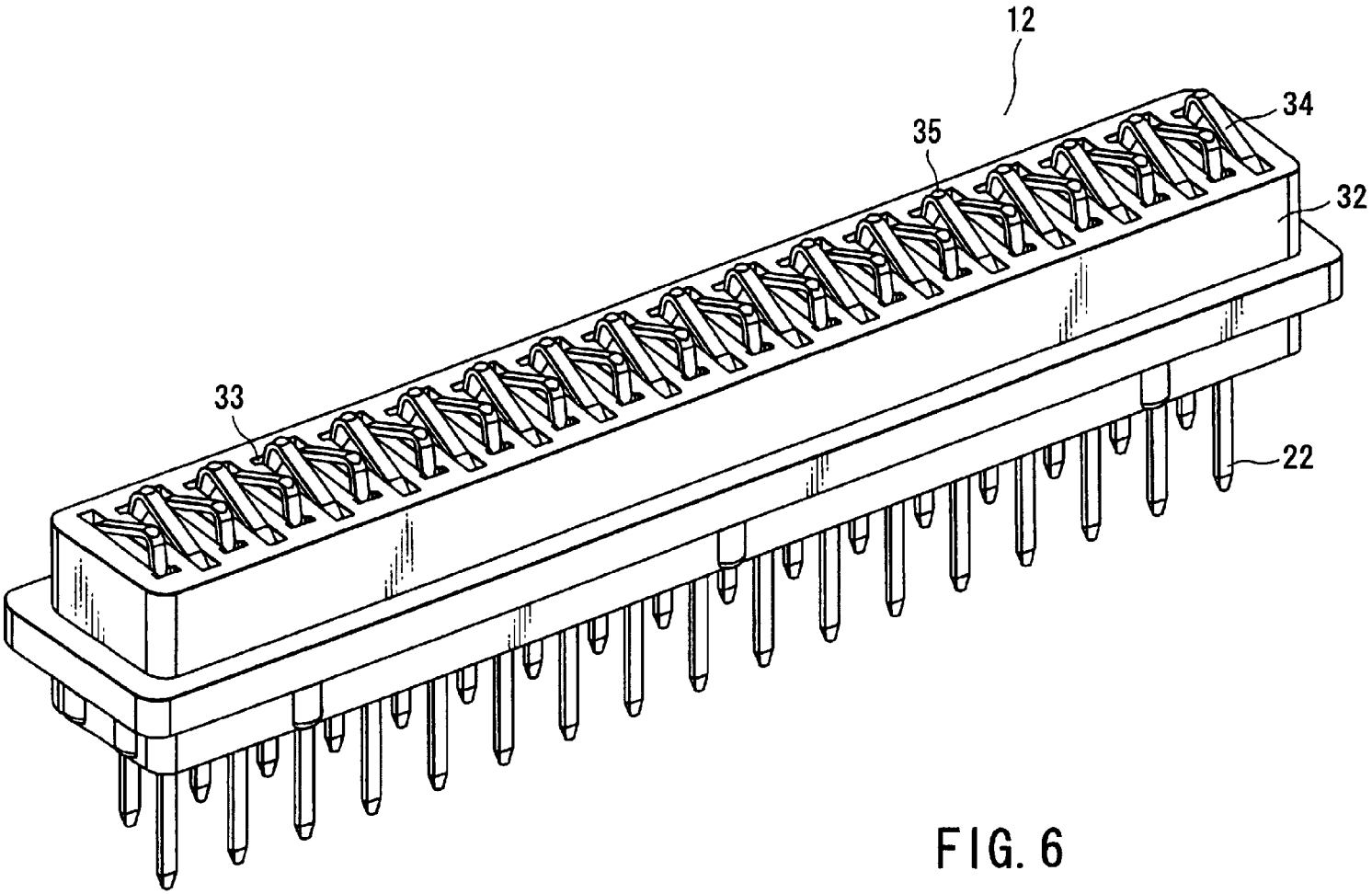
FIG. 6 is a perspective view of a contact module.

In the bottom 20 of the receptacle housing 11, a plurality of almost rectangular holes 21 are made. Contact modules 12, which will be explained by reference to FIG. 6, are pressed into the rectangular holes 21 from above. The way of mounting the contact modules 12 in the receptacle housing 11 is not limited to pressing the modules into the holes. In the lower part of the contact modules 12, a plurality of connecting terminals 22 are so formed that they project downward. The connecting terminals 22 are for making an electrical connection with the electric wiring (not shown) or the circuit board (not shown) of such an electronic apparatus as a medical instrument, semiconductor testing equipment, a computer, and communication equipment.

Furthermore, to make it possible to mount multicore connectors of the present invention in lines on the printed wiring board (not shown) of an electronic apparatus, for example, an alignment pin 23 and/or a mounting hole 24 may be provided on the bottom 20 of the receptacle housing 11.

Figure 3:
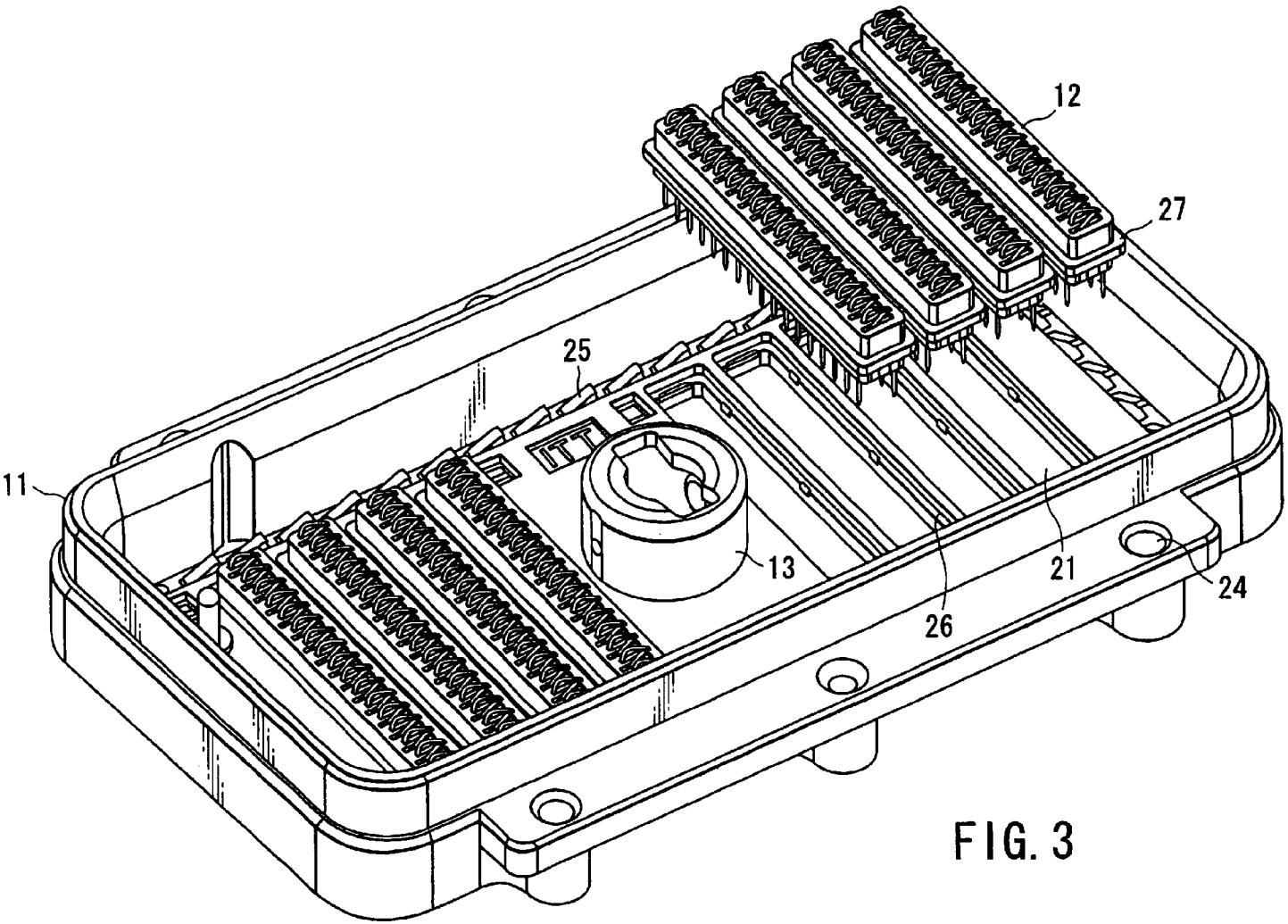
FIG. 3 is a detailed perspective view, from diagonally above, of the receptacle 2 of the multicore connector according to the embodiment.

FIG. 3 is a detailed perspective view, looked diagonally down from above, of the receptacle 2 of the multicore connector according to the present invention. Shown at left are four contact modules 12 pressed into holes 21 made in the bottom of the receptacle housing 11. The way of mounting the modules 12 in the receptacle housing is not limited to pressing the modules into the holes, and may be, for example, fixing the modules with screws. Shown at right are four contact modules 12 before being pressed into the holes. The number of contact modules 12 used in the connector can be determined suitably according to the number of contacts.

In FIG. 3, a projecting part or a shoulder 26 is formed on the side of each substantially rectangular hole 21 in the bottom 20 of the receptacle housing 11. The projecting part or shoulder 26 is combined with a projecting brim 27 formed on the side of the contact module 12, which determines the longitudinal position of the pressed-into contact module 12 with respect to the receptacle housing 11.

Figure 4:
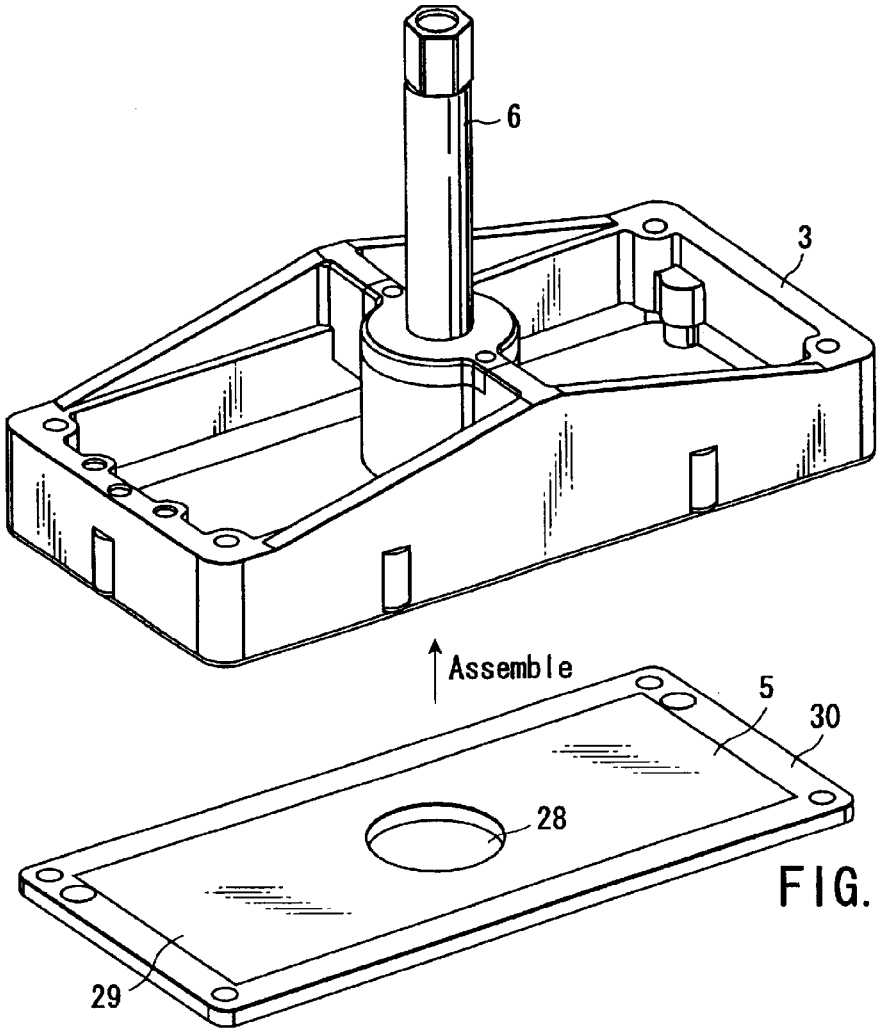
FIG. 4 shows a state where a plug board is assembled into a plug frame.
Figure 7:
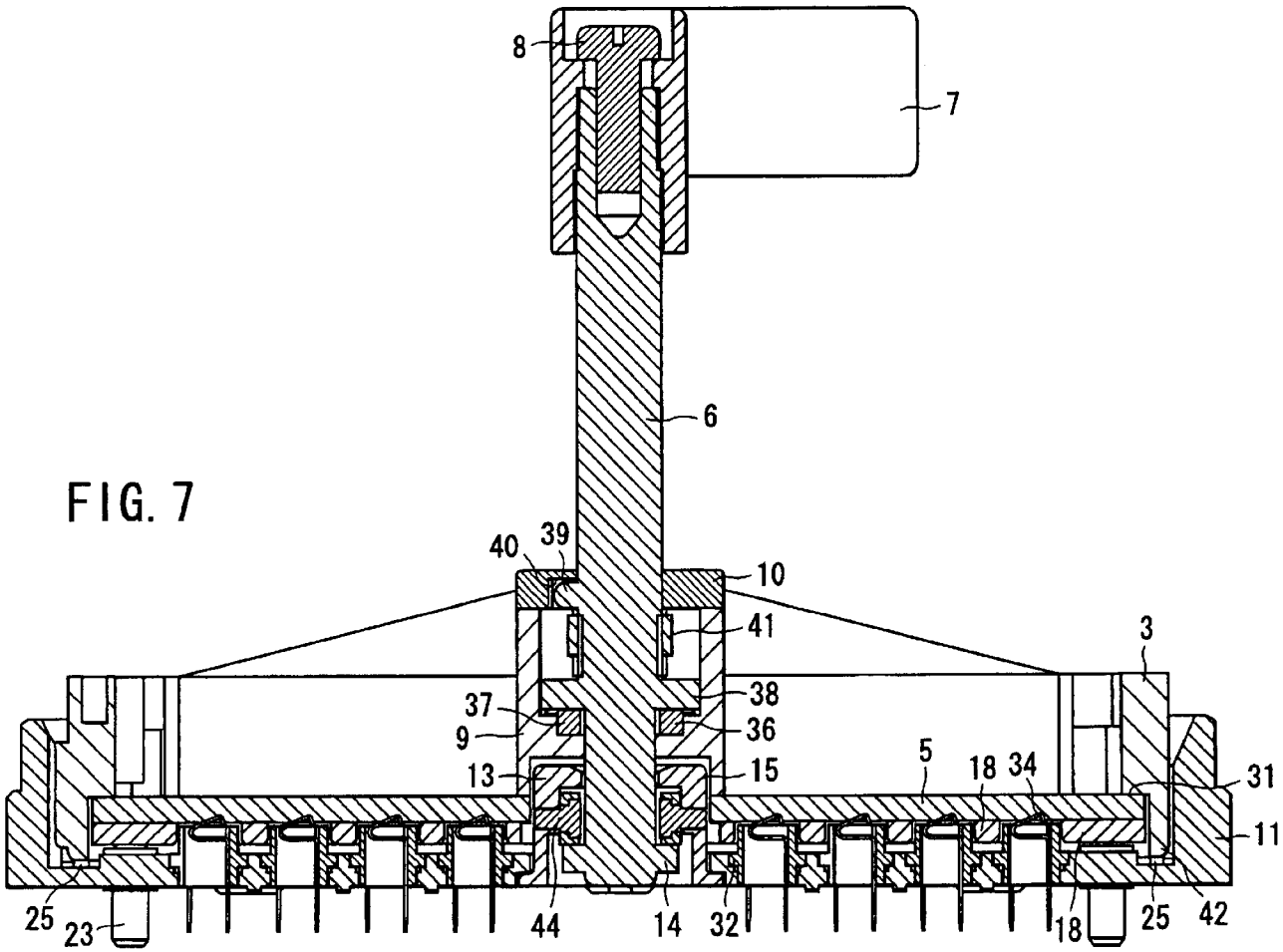
FIG. 7 is a sectional view of the plug and receptacle which are combined completely.

FIG. 4 shows a state where the plug board 5 with the through hole 28 through which the lower part of the cam shaft 6 is passed is assembled into the plug frame 3 on which the cam shaft 6 has been installed. A grounding conductive pattern 30 is formed on the periphery of the top surface 29 of the plug board 5. The conductive pattern 30 contacts the shoulder 31 of the plug frame 3 which can be grounded as shown in FIG. 7, thereby grounding the plug board 5 reliably.

The plug board 5 mounted on the plug frame 3 can be formed by, for example, using either a circuit board with the top-surface wiring and the bottom-surface wiring connected to each other in specified parts or a multilayer wiring circuit board. On the top surface 29 of the plug board, a plurality of electrical connecting parts (not shown) corresponding to the contact pads 17 are formed on the bottom surface. The individual core lines of the multicore cable, such as signal lines from the specified electronic apparatuses connected to a multicore connector of the present invention, are connected to the electrically connecting sections. The present invention is not restricted to the method of making an electrical connection. For instance, an electrical connection may be made by soldering the connections.

Figure 5:
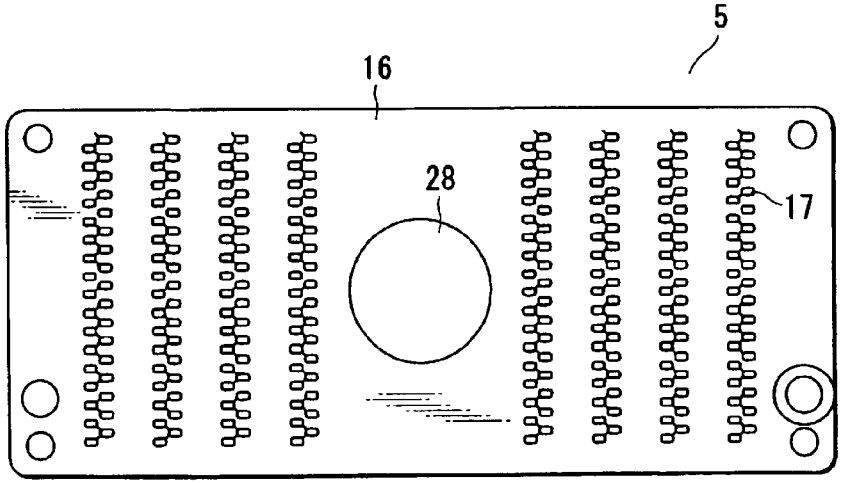
FIG. 5 shows the bottom surface of the plug board with a plurality of contact pads.

FIG. 5 shows the bottom surface 16 of the plug board 5 with a plurality of contact pads 17. The contact pads 17 are connected electrically to the corresponding electrically connecting parts on the top surface of the plug board via the internal wiring (not shown) of the plug board. The contact pads 17 may be formed by partly gold-plating the wiring section of the plug board 5 to assure a good contact state. Alternatively, the contact pads 17 may be made by using metal contact strips provided suitably on the plug board 5. In the plug board 5, a through hole 28 is made which enables the lower part of the cam shaft 6 to pass through.

FIG. 6 is a perspective view of a contact module usable in the present invention. A plurality of grooves 33 passing through in an up and down direction are made in a frame section 32 made of an insulating material. In each groove 33, a spring metal contact strip 34 is inserted, positioned by a suitable method, and fixed there. When the plug 1 is combined with the receptacle 2 completely, the top 35 of the metal contact strip 34 comes into contact with the contact pad 17 on the bottom surface 16 of the plug board 5. The lower part of the metal contact strip 34 forms a connector terminal 22. The connector terminal 22 is connected to the circuit board of an electronic apparatus with a multicore connector, or to a multicore cable.

FIG. 7 is a sectional view of the plug 1 and receptacle 2 which are combined together completely. A ringed bearing plate 37 on which force acting in the direction of the axis of the cam shaft 6 during engagement is exerted is provided on a step part 36 looking to the upper part of the inner wall of the cylindrical section 9 of the plug 1. With the plug 1 inserted in the receptacle 2, the bearing plate 37 facilitates the rotation of the cam shaft 6. The bearing plate 37 is so provided that it faces, in a up and down direction, a ringed projecting part 38 formed on the side of the cam shaft 6, thereby limiting the downward movement of the cam shaft 6.

Inside the sidewall of the substantially cylindrical bushing 13 provided in the central part of the receptacle housing 11, a pair of roller axes 44 is provided in such a manner the axes project horizontally with respect to the axis of the cam shaft 6. A cylindrical roller 15 provided with a clearance so as to be close to the cylindrical side of the cam shaft 6 is mounted rotatably on the roller axes 44.

Further on the side of the cam shaft 6, a rod-like projection 39 projecting laterally in the lower part of the frame cover 9 is preferably formed. When the plug 1 and the receptacle 2 are combined completely, the rod-like projection 39 fits in a specific position of the concave portion of the lower part of the frame cover 9, thereby limiting the rotation of the cam shaft 6.

Furthermore, to clarify the on and off positions of the cam shaft 6, a pair of plate-like return springs 41 are provided on the side of the cam shaft 6. When the combination of the projecting parts 14 of the cam shaft 6 and the rollers 15 is unlocked to remove the plug 1, the cam shaft 6 is actuated so that it may rotate back to the initial position.

Furthermore, as shown in FIG. 7, the lower part 42 of the sidewall of the plug frame 3 can come into electrical contact with the top surface of the bottom of the receptacle housing 11 via the plate springs 25. Therefore, after the plug 1 and the receptacle are combined, a reliable electrical continuity for grounding the plug 1 and receptacle 2 can be obtained.

Figure 8A:
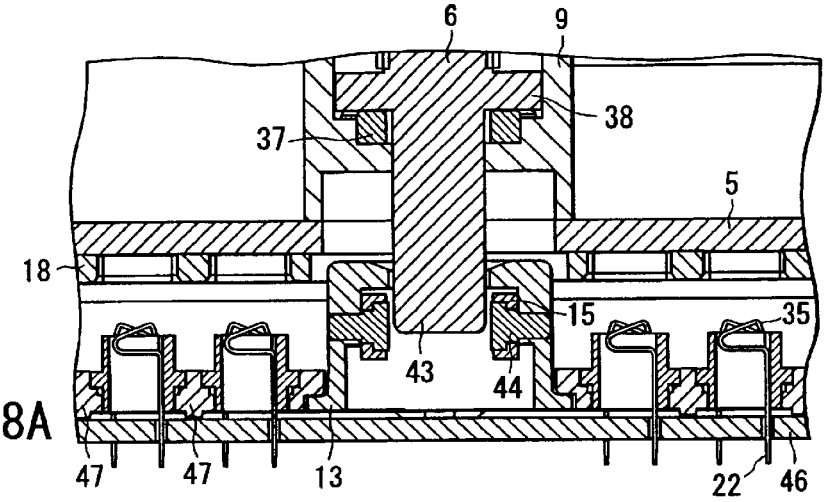
FIGS. 8A to 8C are partly sectional views to help explain the operation of the multicore connector according to the embodiment.
Figure 8B:
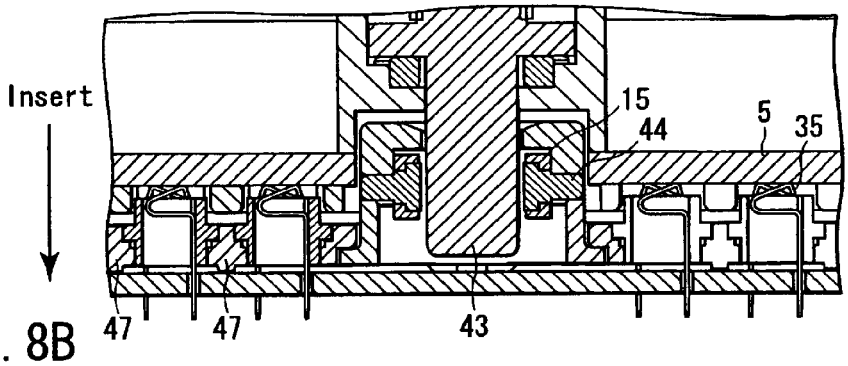
Figure 8C:
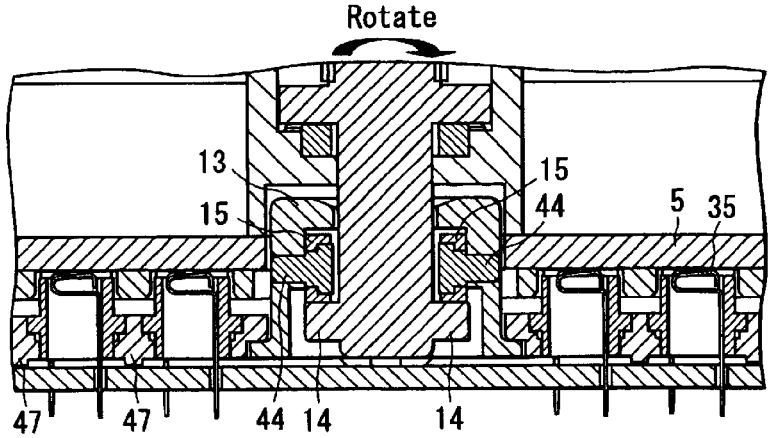

The operation of a multicore connector according to the present invention will be explained briefly by reference to FIGS. 8A to 8C and FIGS. 9A and 9B. FIG. 8A is a sectional view of the plug 1 in the course of being inserted into the receptacle 2. FIG. 8B is a sectional view of the plug 1 almost inserted in the receptacle 2. FIG. 8C is a sectional view of the completed combination after the cam shaft 6 is rotated.

Figure 9A:
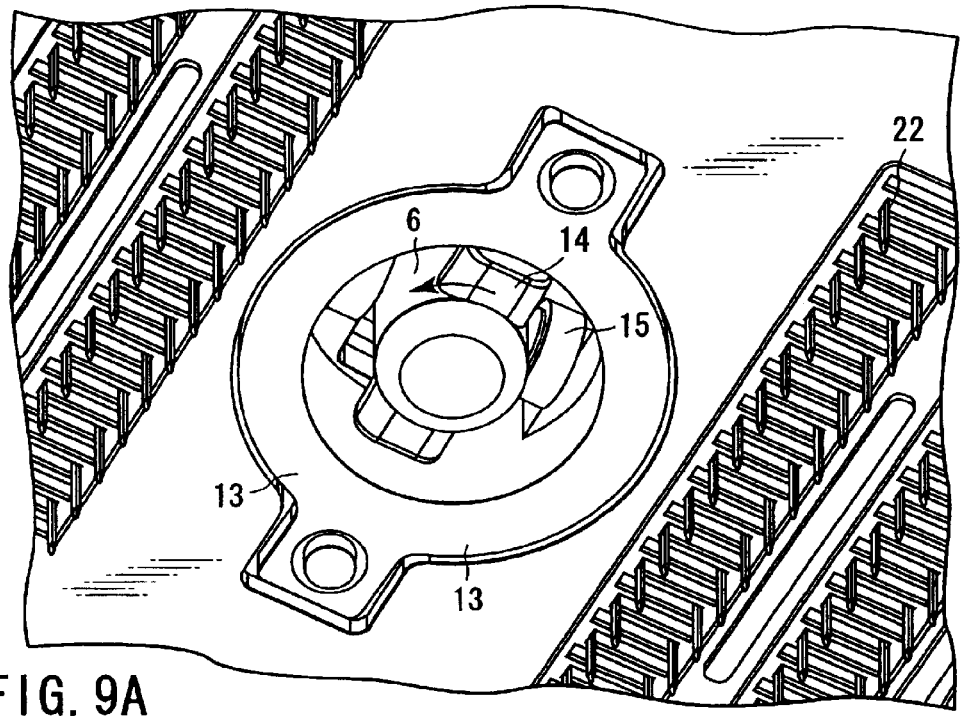
FIGS. 9A and 9B are partial sectional views to help explain the operation of the multicore connector according to the embodiment.
Figure 9B:
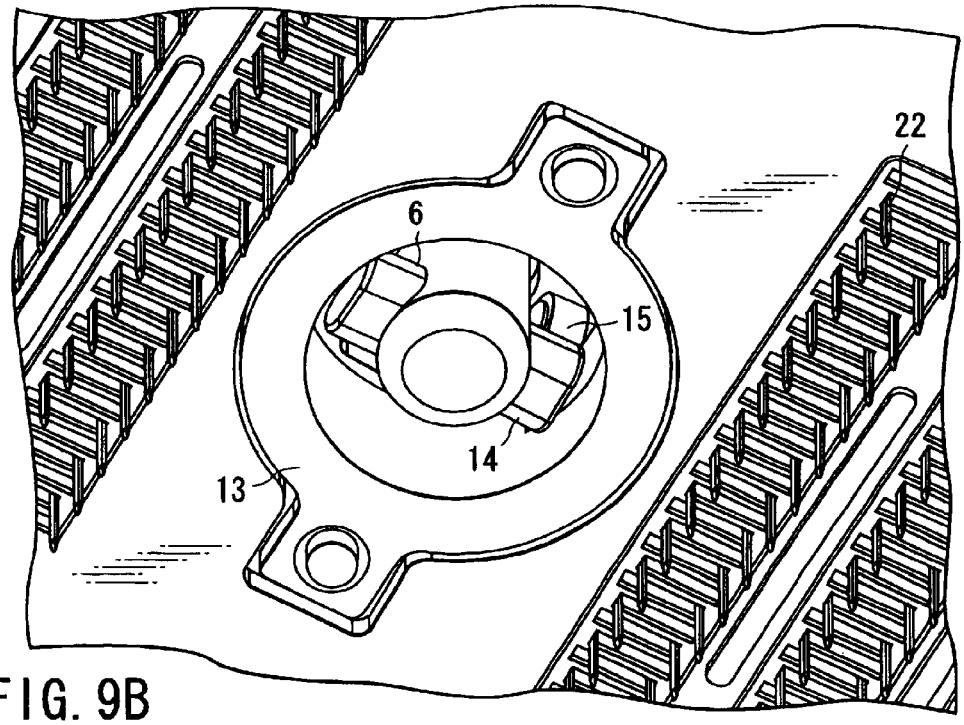

FIG. 9A is a perspective view, from diagonally below, of the plug 1 almost inserted into the receptacle 2 before the rotation of the cam shaft, which corresponds to FIG. 8B. In FIG. 9A, the circuit board 46 of FIGS. 8A to 8C is not shown. FIG. 9B is a perspective view of the completed combination after the cam shaft 6 is rotated, which corresponds to FIG. 8C. In FIGS. 8A to 8C, the connecting terminals 22 actually used are connected to the wiring section (not shown) of the circuit board 46 of the electric apparatus with, for example, solder. The parts indicated by numeral 47 in FIGS. 8A to 8C are a part of the bottom 20 of the receptacle housing 11.

The combination in the connector is carried out as follows: the plug 1 is inserted and pressed into the receptacle 2 (FIG. 8A) until the lower end 43 of the cam shaft 6 has reached a position deeper than the rollers 15 (FIG. 8B), then the shaft 6 is rotated, for example, clockwise about 100 degrees (FIG. 8C).

Rotating the cam shaft 6 clockwise about 100 degrees with the handle 7 causes the pair of projecting parts 14 (see FIG. 8C) provided in the lower part of the cam shaft 6 to get into under the rollers 15 incorporated into the bushing 13 of the receptacle 2, pushing up the lower part of the rotating surface of the rollers 15. The rotation of the rollers 15 makes it easy for the projecting parts 14 to move to positions beneath the rollers 15. Since the roller axes 44 are fixed, the projecting parts 14 are actually actuated downward by the rollers 15. This enables the receptacle 2 to be pulled downwards into the body of the plug 1.

This makes it possible to bring the upper parts 35 of the spring contacts in the contact module 12 incorporated in the bottom 20 of the receptacle 2 into reliable electrical contact with the contact pads 17 provided on the bottom surface 16 of the board 5 of the plug 1.

At the same time, the grounding plate springs 25 mounted on the receptacle 2 are pressed by the lower part 42 of the peripheral part of the plug frame 3. As a result, the lower part 42 of the sidewall of the plug frame 3 comes into electrical contact with the top surface of the bottom of the receptacle housing 11 via the springs 25, thereby making a reliable electrical connection between the plug frame 3 and the receptacle housing 11. As a result, grounding one of the plug 1 and the housing of the receptacle 2 by a suitable method makes it possible to ground the other at the same time. In addition, it is possible to ground the plug board 5 to which the conductive pattern 30 on the periphery contacting the shoulder 31 of the plug frame 3 contacts.

To remove the plug 1 from the receptacle 2, the cam shaft 6 is rotated counterclockwise about 100 degrees with the handle 7, which is the reversal of insertion. Rotating the cam shaft 6 of the plug 1 counterclockwise causes the projecting parts 14 of the cam shaft 6 to come off the rollers 15 of the receptacle 2, which enables the plug 1 to move upward. Therefore, pulling up the plug 1 enables the plug 1 to be unplugged from the receptacle 2. At this time, the contact top 35 of the contact module 12 and the grounding plate springs 25 are separated from the corresponding contact parts, which breaks the individual electrical connections.

Figure 10A:
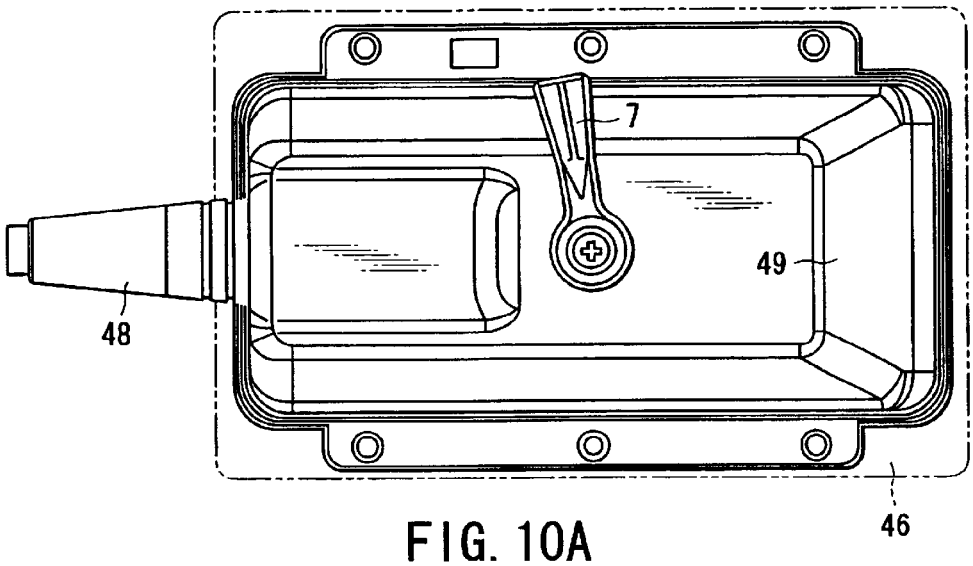
FIGS. 10A and 10B are diagrams to help explain another embodiment of the present invention.
Figure 10B:
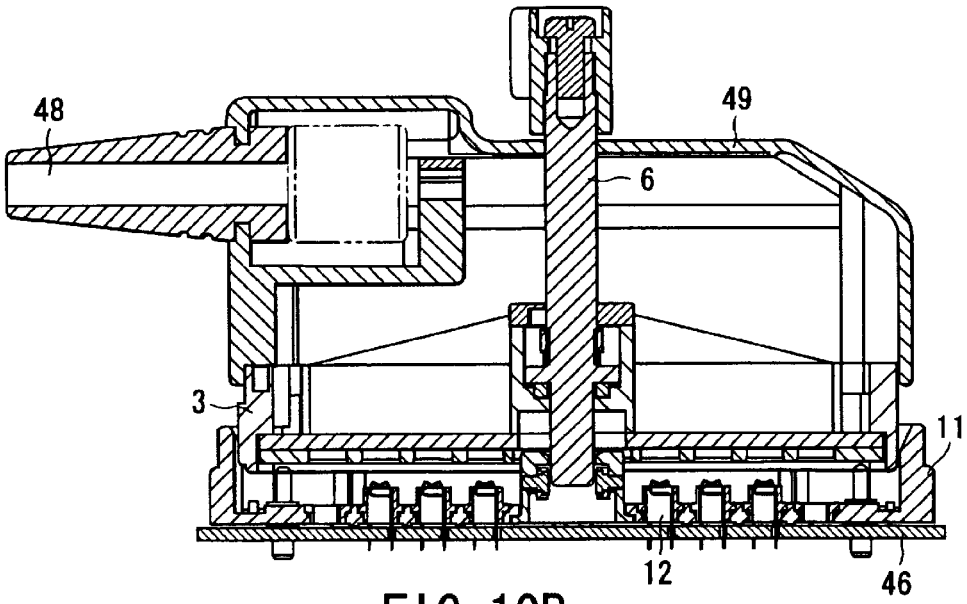
Figure 11:
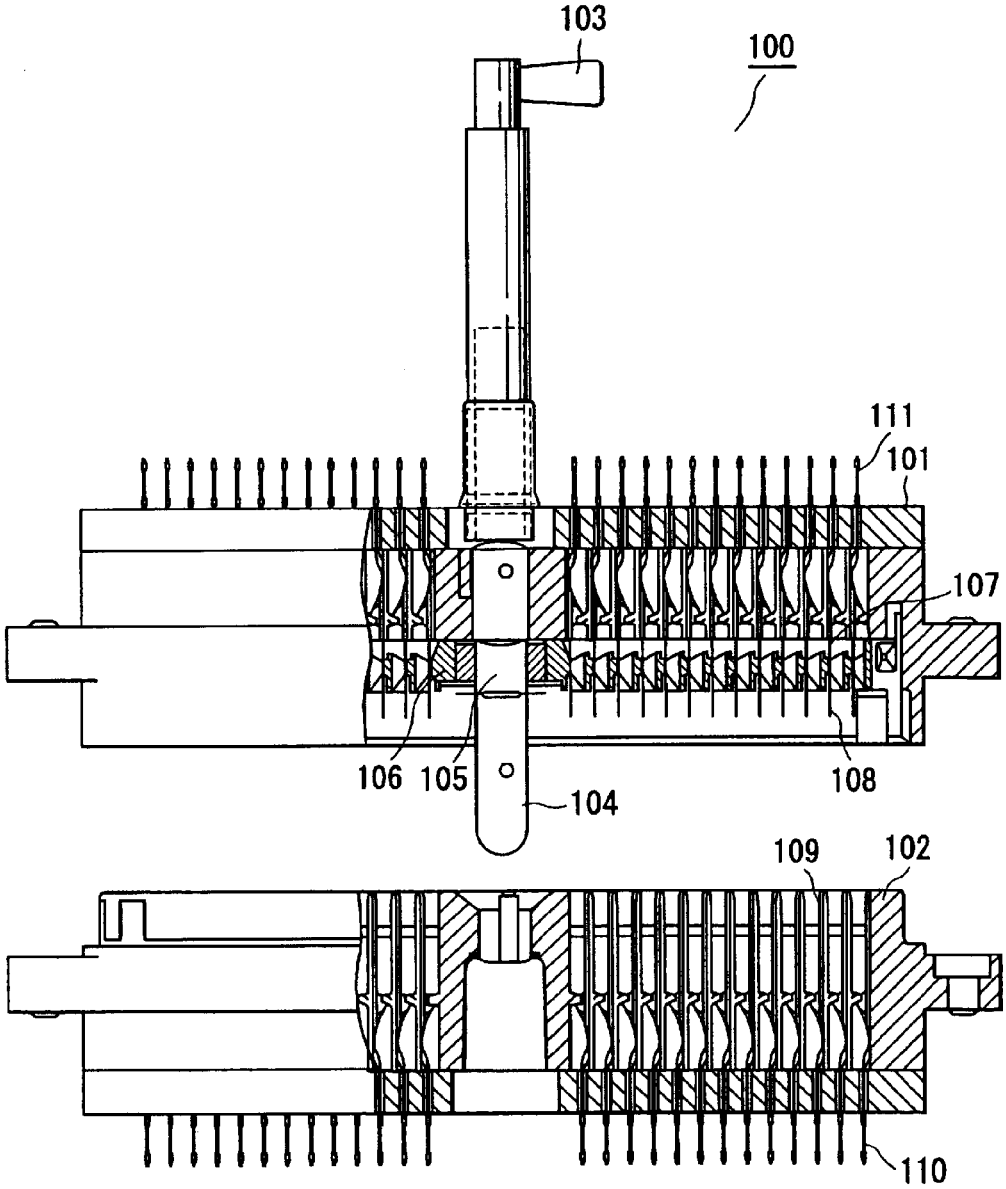
FIG. 11 (PRIOR ART)
FIG. 11 shows an example of a conventional multicore connector.
Figure 12:
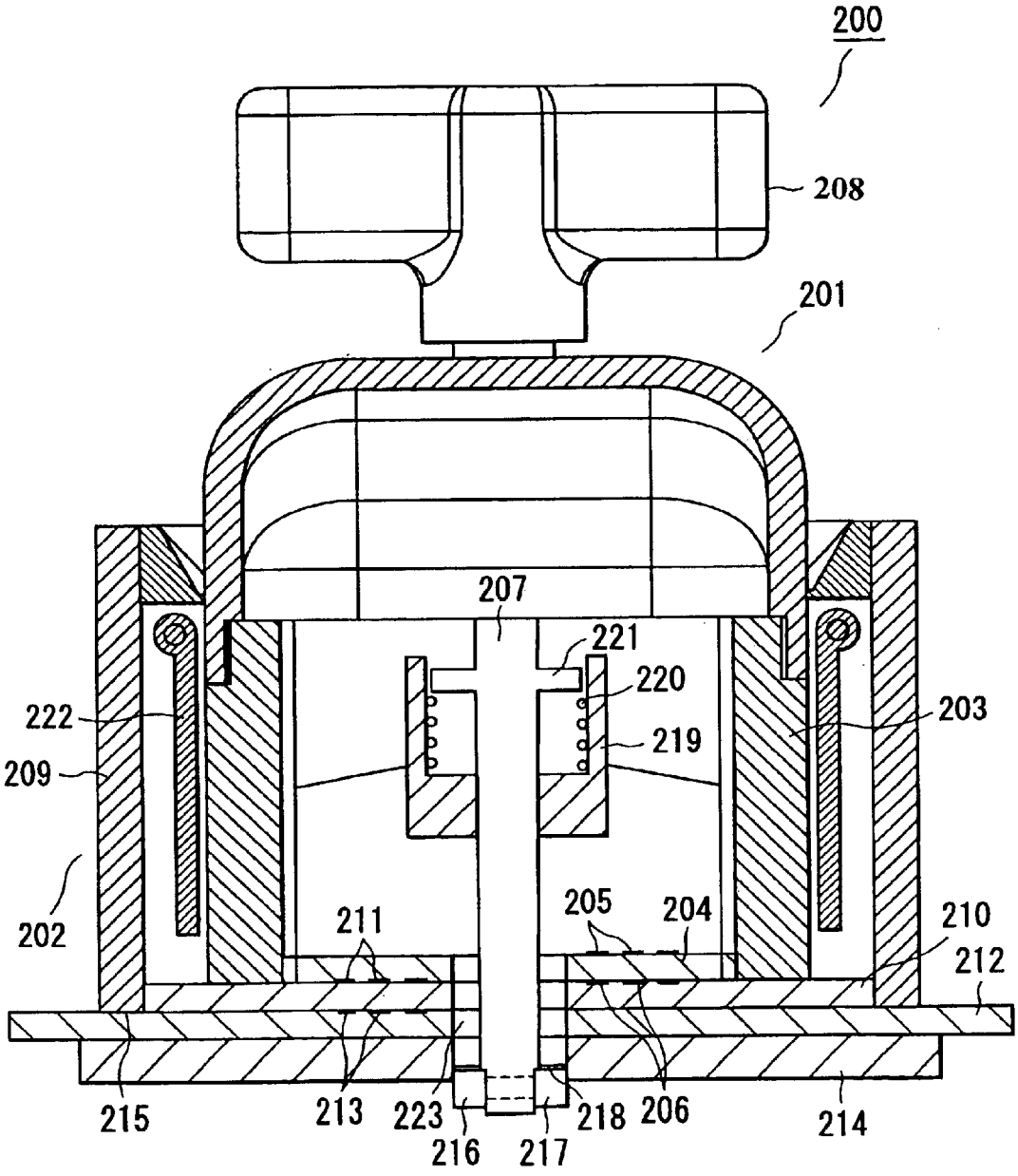
FIG. 12 (PRIOR ART)
FIG. 12 shows another example of a conventional multicore connector.

FIGS. 10A and 10B show another embodiment of the present invention. FIGS. 10A and 10B are a plan view and a sectional view of the embodiment. A multicore connector of FIG. 10 further comprises a lid member 49 with a multicore cable insert section 48 in addition to the multicore connector of FIG. 1. The number of contact modules 12 is 6, smaller than in FIGS. 1 to 9.

According to the present invention, the rotational torque of the cam shaft can be made smaller than the conventional multicore connectors. In addition, the signal lines in the contact section are made shorter, thereby improving the signal transmission characteristic and preventing interference, such as crosstalk, which makes it possible to provide a multicore connector suitable for the transmission of high-speed signals.

Furthermore, it is possible to provide a multicore connector which reduces the number of parts to be mounted in an electronic apparatus, makes the parts mounting area smaller by downsizing the whole connector, and enables the plug housing and receptacle housing to be completely grounded.

The present invention is not limited to the above embodiments and may be practiced or embodied in still other ways without departing from the spirit or essential character thereof.

What is claimed is:

1. A connector for connecting a plurality of signal lines to a specific electronic apparatus which uses the plurality of signal lines, the connector comprising:

a first structural unit that includes a board having a plurality of contact pads to be electrically connected to said plurality of signal lines and a rotatable substantially hollow cylindrical shaft, said rotatable substantially hollow cylindrical shaft passing through the board, extending perpendicular to the board, and having a projecting part protruding from one side; and a second structural unit that includes a bottom, a plurality of spring contact sections provided on the bottom, and a rotatable roller provided on the bottom, each of the plurality of spring contact sections facing, at one end, the corresponding one of the plurality of contact pads and being connectable, at the other end, to the specific electronic apparatus, wherein the first structural unit is to be inserted, in part, into the second structural unit, so that the rotatable roller comes close to the rotatable substantially hollow cylindrical shaft when the rotatable substantially hollow cylindrical shaft and a part of the first structural unit are inserted into the second structural unit, and when the first structural unit is inserted, in part, into the second structural unit and the rotatable substantially hollow cylindrical shaft is rotated through a specific angle, the projecting part comes to a position beneath to push the board against the plurality of contact sections, thereby to bring the plurality of contact pads into contact with the plurality of contact sections, respectively, and wherein the roller is higher in position than a circuit board of the specific electronic apparatus on which the connector is to be mounted.

2. The connector according to claim 1, wherein the board has a grounding conductive pattern section on its periphery, the first structural unit has a frame section with a conductive surface for supporting the board, with the conductive surface of the frame section being electrically connected to the conductive pattern section, the second structural unit has a housing with a conductive surface, with a plurality of conductive springs being provided in specific positions on the bottom surface of the housing, and the frame section and the housing are configured to be electrically connectable to each other via the plurality of conductive springs.

3. The connector according to claim 1, wherein said plurality of contact sections are a contact module in which a plurality of contact sections are previously arranged.

4. The connector according to claim 3, wherein the contact module is a plurality of subdivided contact modules.

5. The connector according to claim 1, wherein the first structural unit has a protective cover for protecting the plurality of contact pads under the board.

6. The connector according to claim 1, wherein said plurality of contact sections have connecting terminals projecting downward with respect to the bottom.

7. The connector according to claim 1, wherein the bottom has an alignment pin and/or a mounting hole for making alignment with the circuit board of the specific electronic apparatus on which the connector is to be mounted.

8. The connector according to claim 1, wherein the rotatable roller is mounted on a cylindrical bushing provided on the bottom.

9. A connector for connecting a plurality of signal lines to a specific electronic apparatus which uses the plurality of signal lines, the connector comprising:

a first structural unit that includes a board having a plurality of contact pads to be electrically connected to said plurality of signal lines and a rotatable substantially hollow cylindrical shaft, said rotatable substantially hollow cylindrical shaft passing through the board, extending perpendicular to the board, and having a projecting part protruding from one side; and a second structural unit that includes a bottom, a plurality of spring contact sections provided on the bottom, and a rotatable roller provided on the bottom, each of the plurality of spring contact sections facing, at one end, the corresponding one of the plurality of contact pads and being connectable, at the other end, to the specific electronic apparatus, wherein the first structural unit is to be inserted, in part, into the second structural unit so that the rotatable roller comes close to the rotatable substantially hollow cylindrical shaft when the rotatable substantially hollow cylindrical shaft and a part of the first structural unit are inserted into the second structural unit, and when the first structural unit is inserted, in part, into the second structural unit and the rotatable substantially hollow cylindrical shaft is rotated through a specific angle, the projecting part comes to a position beneath to push the board against the plurality of contact sections, thereby to bring the plurality of contact pads into contact with the plurality of contact sections, respectively, and wherein the board has a grounding conductive pattern section on its periphery, the first structural unit has a frame section with a conductive surface for supporting the board, the conductive surface of the frame section being electrically connected to the conductive pattern section, the second structural unit has a housing with a conductive surface and a plurality of conductive springs being provided in specific positions on the bottom surface of the housing, the frame section and the housing being electrically connectable to each other via the plurality of conductive springs.

10. A connector for connecting a plurality of signal lines to a specific electronic apparatus which uses the plurality of signal lines, the connector comprising:

a first structural unit that includes a board having a plurality of contact pads to be electrically connected to said plurality of signal lines and a rotatable substantially hollow cylindrical shaft, said rotatable substantially hollow cylindrical shaft passing through the board, extending perpendicular to the board, and having a projecting part protruding from one side; and a second structural unit that includes a bottom, a plurality of spring contact sections provided on the bottom, and a rotatable roller provided on the bottom, each of the plurality of spring contact sections facing, at one end, the corresponding one of the plurality of contact pads and being connectable, at the other end, to the specific electronic apparatus, wherein the first structural unit is to be inserted, in part, into the second structural unit so that the rotatable roller comes close to the rotatable substantially hollow cylindrical shaft when the rotatable substantially hollow cylindrical shaft and a part of the first structural unit are inserted into the second structural unit, and when the first structural unit is inserted, in part, into the second structural unit and the rotatable substantially hollow cylindrical shaft is rotated through a specific angle, the projecting part comes to a position beneath to push the board against the plurality of contact sections, thereby to bring the plurality of contact pads into contact with the plurality of contact sections, respectively, and wherein said plurality of contact sections are a contact module in which a plurality of contact sections are previously arranged.

11. A connector for connecting a plurality of signal lines to a specific electronic apparatus which uses the plurality of signal lines, the connector comprising:

a first structural unit that includes a board having a plurality of contact pads to be electrically connected to said plurality of signal lines and a rotatable substantially hollow cylindrical shaft, said rotatable substantially hollow cylindrical shaft passing through the board, extending perpendicular to the board, and having a projecting part protruding from one side; and a second structural unit that includes a bottom, a plurality of spring contact sections provided on the bottom, and a rotatable roller provided on the bottom, each of the plurality of spring contact sections facing, at one end, the corresponding one of the plurality of contact pads and being connectable, at the other end, to the specific electronic apparatus, wherein the first structural unit is to be inserted, in part, into the second structural unit so that the rotatable roller comes close to the rotatable substantially hollow cylindrical shaft when the rotatable substantially hollow cylindrical shaft and a part of the first structural unit are inserted into the second structural unit, and when the first structural unit is inserted, in part, into the second structural unit and the rotatable substantially hollow cylindrical shaft is rotated through a specific angle, the projecting part comes to a position beneath to push the board against the plurality of contact sections, thereby to bring the plurality of contact pads into contact with the plurality of contact sections, respectively, and wherein said plurality of contact sections have connecting terminals projecting downward with respect to the bottom.

12. The connector according to claim 11, wherein said plurality of contact sections are a contact module in which a plurality of contact sections are previously arranged.

13. The connector according to claim 12, wherein the contact module is a plurality of subdivided contact modules.

14. The connector according to claim 11, wherein the roller is higher in position than a circuit board of the specific electronic apparatus on which the connector is to be mounted.

15. The connector according to claim 11, wherein the first structural unit has a protective cover for protecting the plurality of contact pads under the board.

16. The connector according to claim 11, wherein the bottom has an alignment pin and/or a mounting hole for making alignment with a circuit board of the specific electronic apparatus on which the connector is to be mounted.

17. The connector according to claim 11, wherein the rotatable roller is mounted on a cylindrical bushing provided on the bottom.

* * * * *